US007743706B1

(12) United States Patent
Lai

(10) Patent No.: US 7,743,706 B1
(45) Date of Patent: Jun. 29, 2010

(54) BULLET CLEANER FOR A GUN BARREL

(76) Inventor: David Lai, 220 S. Linden Ave., South San Francisco, CA (US) 94080

( * ) Notice: Subject to any disclaimer, the term of this patent is extended or adjusted under 35 U.S.C. 154(b) by 34 days.

(21) Appl. No.: 11/603,467

(22) Filed: Nov. 21, 2006

(51) Int. Cl.
*F42B 5/24* (2006.01)

(52) U.S. Cl. ..... 102/442; 102/529; 42/95

(58) Field of Classification Search ..... 102/442, 102/502, 529; 42/95
See application file for complete search history.

(56) References Cited

U.S. PATENT DOCUMENTS

| | | | | | |
|---|---|---|---|---|---|
| 721,050 | A * | 2/1903 | Kersey | 102/529 |
| 802,301 | A * | 10/1905 | Michele | 102/430 |
| 1,039,774 | A * | 10/1912 | Melander | 102/511 |
| 1,376,316 | A * | 4/1921 | Chilowsky | 102/511 |
| 1,481,930 | A * | 1/1924 | Schneider | 102/511 |
| 1,495,008 | A * | 5/1924 | Feagin | 102/442 |
| 2,011,249 | A * | 8/1935 | Larson | 102/511 |
| 2,442,155 | A * | 5/1948 | Weese | 102/529 |
| 3,147,708 | A * | 9/1964 | Ferguson | 102/442 |
| 3,208,387 | A * | 9/1965 | Giles | 102/511 |
| 3,820,465 | A * | 6/1974 | Delphia | 102/512 |
| 4,204,474 | A * | 5/1980 | Mizelle | 102/502 |
| 4,513,668 | A * | 4/1985 | Fuller | 102/511 |
| 4,858,534 | A * | 8/1989 | Wallace | 102/511 |
| 5,233,128 | A * | 8/1993 | Lai | 102/511 |
| 5,654,524 | A * | 8/1997 | Saxby | 102/513 |
| 5,777,258 | A * | 7/1998 | Soon | 102/442 |
| 7,331,293 | B2 * | 2/2008 | Saxby | 102/513 |

* cited by examiner

*Primary Examiner*—Michael Carone
*Assistant Examiner*—Michael D David
(74) *Attorney, Agent, or Firm*—Robert S. Smith

(57) ABSTRACT

A bullet for cleaning/scouring the interior surface of a gun barrel including a jacket section on a rear end and joined to a projectile section on the other end forming a chamber containing a cleaning liquid. An array of brushes is positioned on the outside surface of the forward wall of the projectile section. An explosive cake is positioned against the rear end of the jacket section. A piston disk is positioned against the cake. When the cake is detonated, the disk first expels fluid from the chamber and against the interior wall of the barrel. Then the disk forces the forward wall to spread out so that the brushes on the forward wall come into contact with the interior surface of the gun barrel.

3 Claims, 6 Drawing Sheets

BULLET CLEANER FOR A GUN BARREL

FIELD OF THE INVENTION

This invention is directed toward devices for cleaning the bore of a gun barrel and particularly toward a projectile that removes deposits such as rust that are tenaciously held to the interior wall of a gun barrel when the projectile is fired.

BACKGROUND AND INFORMATION DISCLOSURE

Gun barrels are subject to collection of dirt and rust that cling tenaciously to the interior surface of the gun barrel and interfere with the intended function of the gun.

Such devices have been disclosed in the literature.

For example, U.S. Pat. No. 5,233,128 to Lai discloses a "cleaning" bullet having a chamber containing a cleaning fluid within a case whose outer surface is lined with bristles. Upon firing the bullet, a piston slidably positioned in the chamber forces the fluid through discharge ports in the head of the bullet. thereby distributing the fluid on the interior wall of the gun barrel. As the projectile accelerates down the barrel, the brushes scour the interior surface of the barrel.

A problem with this device is that clearance between the outside surface of the projectile must be provided in order to load the projectile into the barrel and still maintain stiff contact between the projectile and the surface of the barrel The bristles must be sufficiently stiff to overcome the adhesion of the particle to the surface yet not score the surface, The problem is compounded by the requirement that the bristles maintain a constant force against the wall with a force that does not result in scratching the surface of the tube wall.

SUMMARY OF THE INVENTION

It is an object of this invention to provide device and method of use for removing foreign matter from the interior surface of a gun barrel.

It is contemplated that the surface of the device in contact with the interior surface of the tube will exert a force normal to the interior surface so as to maintain contact with the tube surface.

This invention is directed toward a projectile fired through the barrel in which a cleaning-lubricating fluid passes through the barrel followed by the projectile having an array of brushes extending into contact with the surface of the gun barrel.

DESCRIPTION OF A BEST MODE

Figure 1:
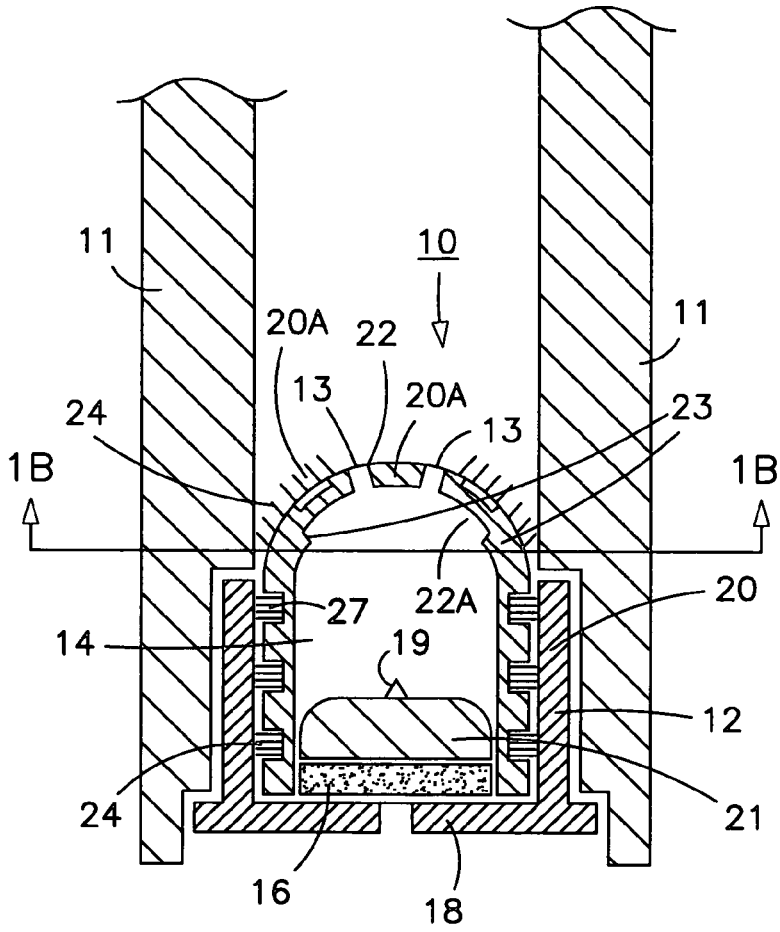
FIG. 1 is a sectional view of the cleaning bullet of this invention.

Turning now to a discussion of the drawings, FIG. 1 is a sectional view of the cleaning bullet 10 of this invention positioned in the barrel 11 of a gun.

There is shown a cylindrical jacket 12 with a rear wall 18 on one end and a projectile section 15 telescoping into the jacket 12 and having a forward wall section 20A on the other end. The jacket, rear wall and projectile section enclose a chamber 14 filled with a cleaning-lubricating fluid 15.

Figure 2:
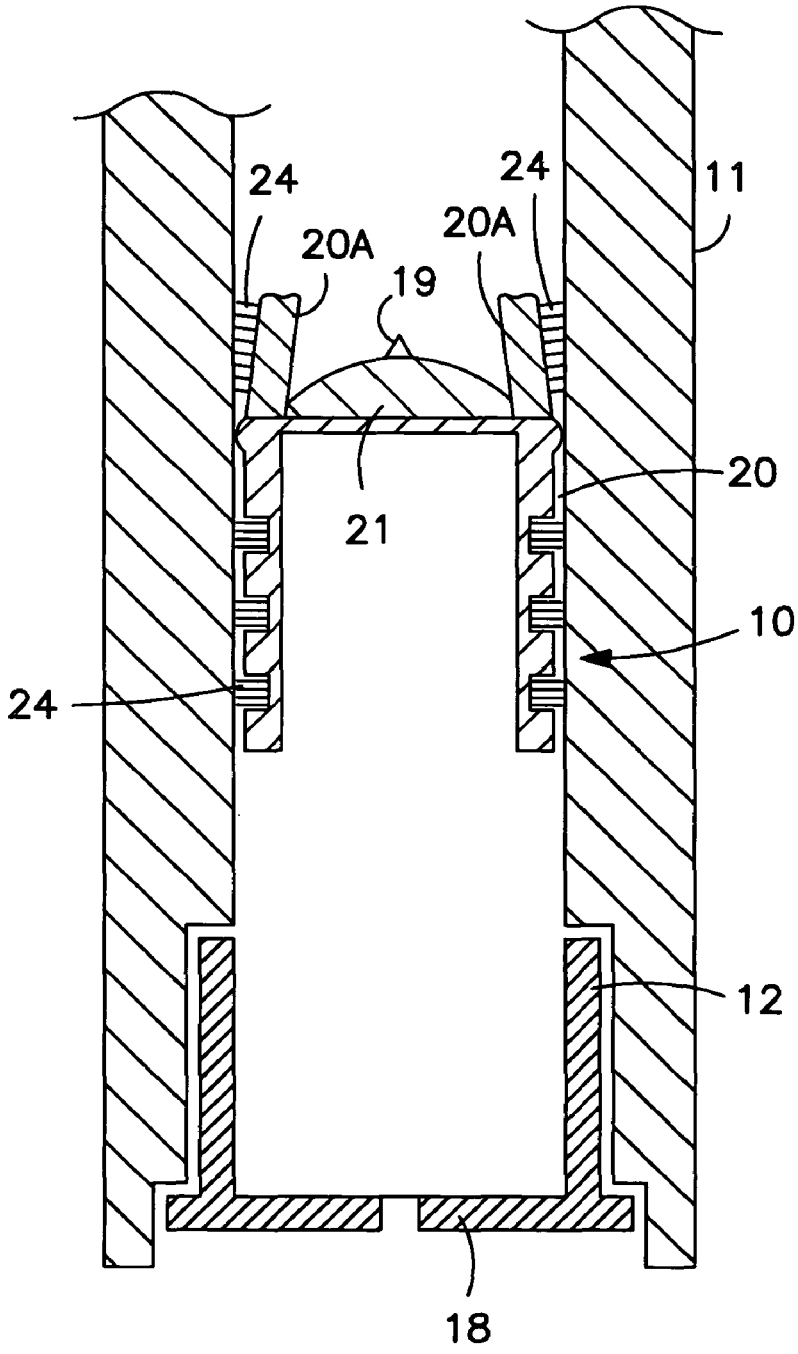
FIG. 2 is a sectional view after the bullet has been fired.

An explosive cake 16 is positioned against the rear wall 18. A piston 21 is positioned against the explosive cake 16. In FIGS. 1 and 2, the piston is a disk having a pin 19 extending from the disk 21 toward the projectile section 20.

In a preferred arrangement, a plurality of bristles 24 are secured in trenches 27 on the outside surface of the projectile section 20 and the forward wall 20A.

Details of the bristles 24 in a trench 27 are shown in the cutaway

Figure 1A:
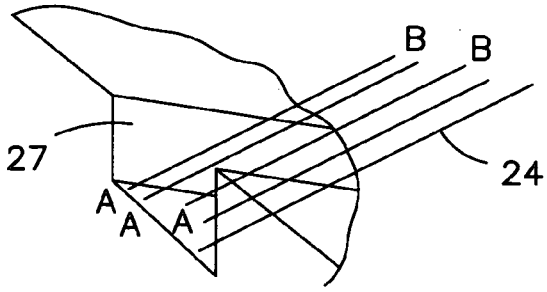
FIG. 1A is a cutaway view of a trench holding bristles.

Perspective view of FIG. 1A. The one end A of each bristle 24 is secured to the floor of the trench 27]. The other end B of each bristle is depressed by contact with the interior surface of jacket 12 (not shown), This arrangement facilitates positioning the bullet into the firing chamber of the barrel 11.

When the projectile escapes from the jacket 12, the free end B of the bristles 26 spring into contact with the surface of the barrel 11.

Bristles of anyone trench extend from the floor of the respective trench in a direction counter to the bristles in the neighboring trench relative to the centerline of the bullet (i.e., clockwise vs. counterclockwise0.

At least one exit port 22 is formed in the forward outside surface 20A of the projectile section 15.

Figure 3:
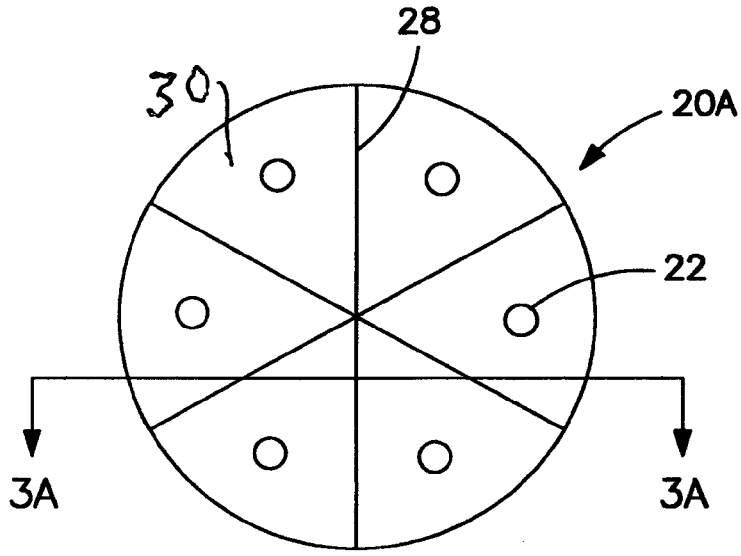
FIG. 3 is a top view of the bullet of FIG. 1.

FIG. 3 is a top view showing details of the forward wall 20A of the projectile section 20.

The forward wall 20A of the projectile section 20 has a; plurality of exit ports 22. Each exit port 22 has a thin seal 13 (see FIG. 1) that prevents escape of fluid 15 from chamber 14 before firing but which is ruptured during firing allowing the fluid 15 to escape from chamber 14 as the projectile section 15 and the disk 21 leave the jacket 12 and the barrel 11.

Figure 3A:
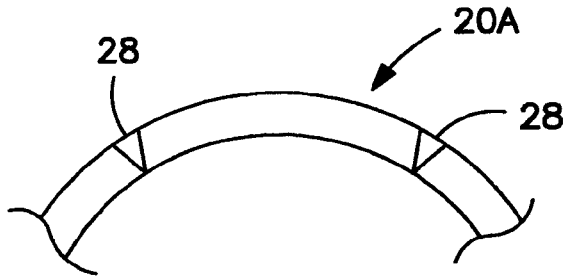
FIG. 3A is a sectional view showing the seam construction.

The forward wall 20A of the projectile section 15 also has a radial array of seams 28. FIG. 3A is a sectional view taken along view line 3A of FIG. 3 showing seams 28. Splitting of the forward wall 20A occurs along these lines when the disk 21 engages the forward wall 20A during firing.

The seams 28 define sections 30 of the forward wall 20A of the projectile section 20.

When the cake 16 is detonated, the piston (disk 21}_travels through the projectile section 20 forcing the fluid 15 through pores 22 and against the interior surface of the gun barrel 14. The fluid thereby serves to lubricate and clean the interior surface 11A of the barrel 11.

The disk_16 is forced through the projectile section 20 and up to the forward wall 22A causing the sections 30 of the forward wall 20A to separate from one another along seams 28 and fan out against the interior surface of the barrel 11. The brushes 24 on the outside of the forward wall 20A and projectile section 20 are forced into contact with the internal surface of the barrel 11.

Figure 4:
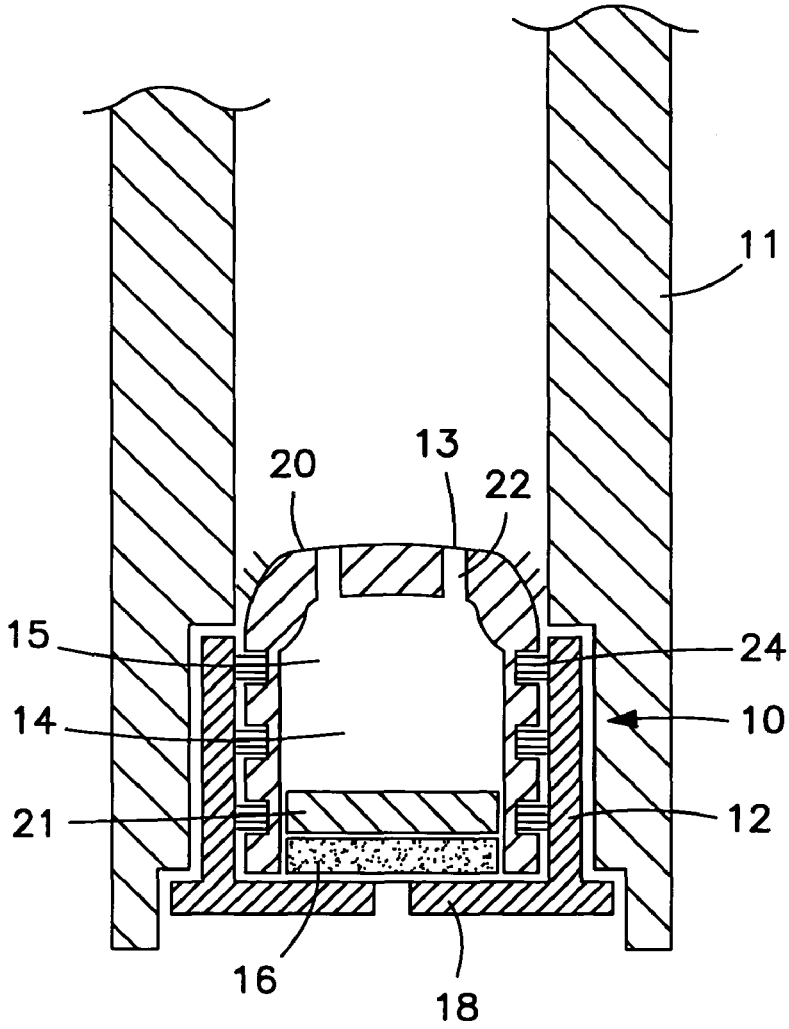
FIG. 4 is a sectional view of another version of the invention having an expanding forward wall

FIGS. 1 and 4 show a bulge 23 in the internal surface of the projectile section 20 where the forward wall 20A is joined to the main body of the projectile section 20, As shown in FIG. 2, the bulge conforms to the contoured surface of the disk 18 after firing forcing the seams to slit and forcing the brushes 24 against the interior surface of barrel 11.

Figure 1B:
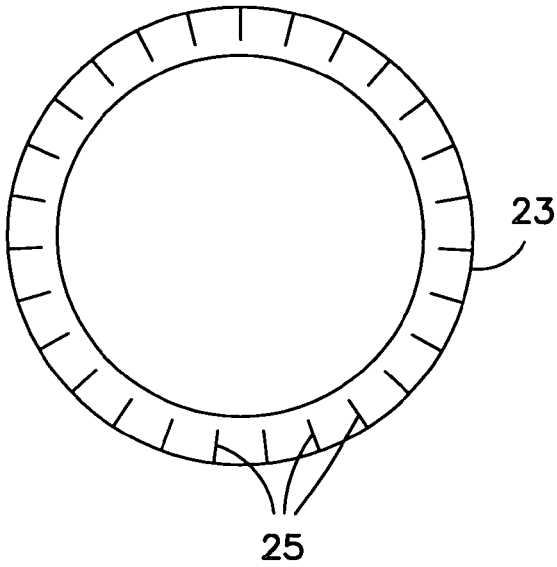
FIGS. 1B and 1C show slits at the bulge aiding expansion of the forward wall.

FIG. 1B is a sectional view taken along view line 1B of FIG. 1 showing an array of slits 25 on the outside surface of bulge section 23. The slits permit the bulge section 23 to stretch when forced by the disk 21 thereby forcing brushes 24 A against the interior surface of barrel 11.

Figure 1C:
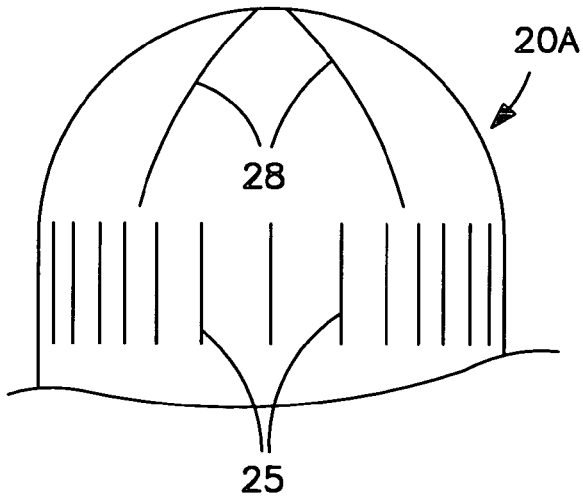

FIG. 1C is a cutaway view before firing of the outside surface where the projectile section 20 is joined to the forward wall 20A.

The rupture into sections of the forward wall 20A attached to the projectile section 20, is also aided by pin 19 mounted on the forward surface of piston 18.

Figure 5:
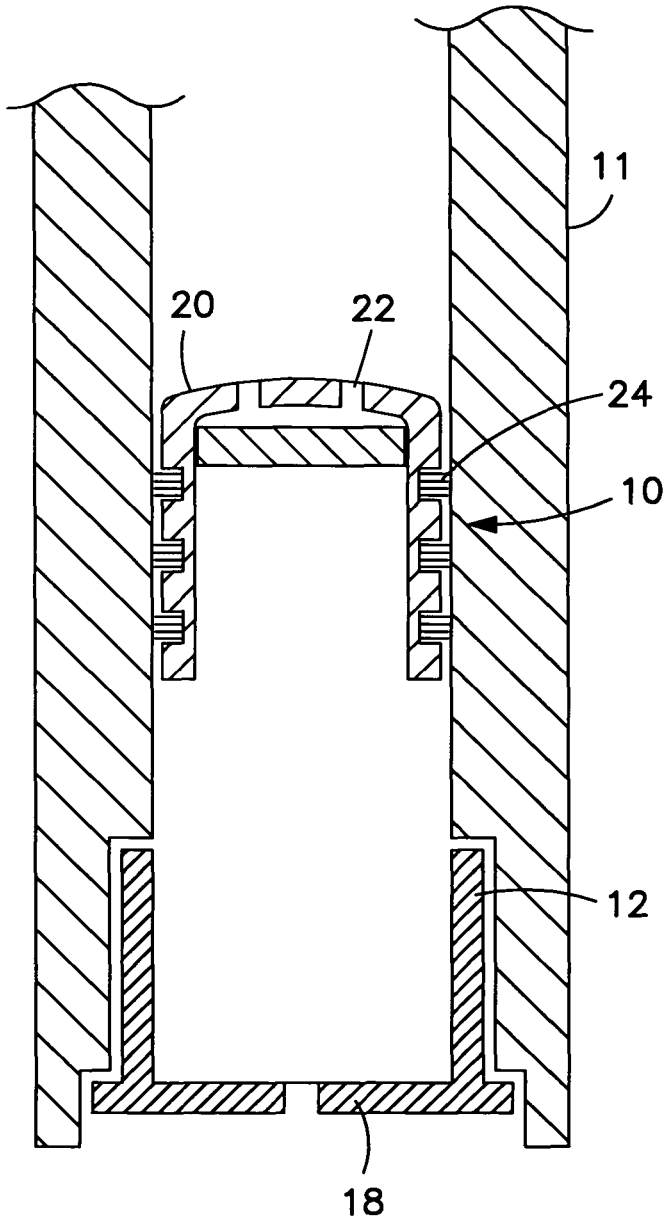
FIG. 5 is a sectional view of FIG. 4 after firing.

FIGS. 4 and 5 are sectional views of another version of the invention.

FIG. 4 shows the bullet before firing in which the projectile section is composed of an elastic polymer.

FIG. 5 shows the bullet of FIG. 4 after firing. The disk (piston) has traveled to the forward end of j12 expelling fluid from jacket 12. This causes the Projectile section 20 to bulge so that the brushes 24 come into contact with the interior surface of the barrel 11.

The material comprising the jacket is preferably a thermosetting plastic chosen for relative strength and heat resistance. The projectile section 20 is an expandable medium such as a thermoplastic chosen for its elastomeric properties The edges of the jacket and projectile section are joined by an ultrasonic weld/

There has been described a cleaning bullet for a fun barrel which has important advantages compared to the cleaning bullet of the prior art. For example, the present invention permits the jacket of the bullet to have a diameter which fits more snugly into the barrel of the gun compared to the prior art.

Variations and modifications contemplated after reading the specification and studying the drawings which are within the scope of the invention.

For example, regarding the material selected for the array of brushes, in one embodiment, the array of brushes are arranged so that the first brush to contact an area of the interior surface is metal (steel or copper). The next set of brushes is cotton selected to wipe the surface clean.

In view of such versions, it is intended that the scope of the invention be defined by the appended claims.

What is claimed is:

1. A bullet (10) for cleaning an interior surface of a gun barrel (11), said bullet comprising:

a cylindrical cartridge section (12) having an open end and an opposite end closed by a rear wall (18);

said cylindrical cartridge section (12) having a diameter selected to provide that said open end of said cylindrical cartridge section (12) is enabled to telescope into a shell chamber of a gun barrel (11);

a rear wall (18) enclosing a rear end of said cylindrical cartridge section (12);

a cylindrical projectile section (20) having an open end telescoped through an open end of said cartridge section (12) to said rear wall (18);

an explosive cake (16) positioned against said rear wall (18) and inside said open end of said projectile section (20) and said cartridge section (12);

a disk (21) positioned against said cake and inside said projectile section (20) and said cartridge section (12); said disk including a pin (19);

a forward wall section (20A) joined to an end of said projectile section (20) opposite said rear wall (18);

said cylindrical cartridge section (12), projectile section (20) and forward section (20A) enclosing a chamber (14);

a lubricating cleaning fluid filling said chamber (14);

at least one exit port (13) formed in said forward wall a plurality of trenches circumferentially arranged on an outside surface of said projectile section (20) and forward wall (20A);

a plurality of brushes having bristles with one end secured to a floor of each trench (27);

said bristles contacting said interior surface of said barrel when said projectile section (20) is propelled through said gun barrel after said explosive cake (16) is detonated;

said forward wall (20A) having an array of seams extending radially from a centerline of said forward wall, said seams defining sections of said forward wall providing that when said disk is propelled toward said forward wall, said pin and disk force said sections apart from one another along said seams and force said plurality of brushes on said forward wall into contact with said interior surface of said barrel;

an interior wall bulge (23) at a location on an interior surface of said projectile section (20) where said projectile section (20) is joined to said forward wall (20A);

slits in an outer surface of said forward wall (20A) where said forward wall (20A) is joined to said projectile section (20) providing that when said cake (16) explodes and said disk encounters said interior wall bulge, an outer surface of said projectile section and said forward wall is forced to expand and force said brushes against said interior surface of said barrel.

2. The bullet of claim 1 wherein a material of said brushes is selected from a group of materials consisting of a fabric and a metal.

3. The bullet of claim 1 wherein bristles of any one trench extend from the floor of the respective trench in a direction counter to the bristles in the neighboring trench relative to the center line of the bullet.

* * * * *